United States Patent [19]

Lindemann

[11] Patent Number: 4,635,650

[45] Date of Patent: Jan. 13, 1987

[54] PIPE CLEANER

[76] Inventor: Gilbert W. Lindemann, 1032 W. Iowa Ave., St. Paul, Minn. 55117

[21] Appl. No.: 726,153

[22] Filed: Apr. 22, 1985

[51] Int. Cl.[4] ..... A24F 9/06

[52] U.S. Cl. ..... 131/245; 131/243; 131/246; 131/329

[58] Field of Search ..... 131/243, 245, 246, 329

[56] References Cited

U.S. PATENT DOCUMENTS 1,477,207 12/1923 Brown ..... 131/245

FOREIGN PATENT DOCUMENTS 8231 of 1915 United Kingdom ..... 131/245

*Primary Examiner*—V. Millin

*Attorney, Agent, or Firm*—Thomas B. Tate

[57] ABSTRACT

The invention is a device for cleaning tobacco residues from smoking pipes, comprising a generally hairpin-shaped piece of wire having one leg coiled to clean the bowl of a pipe and the other leg kinked to clean the stem of a pipe.

1 Claim, 3 Drawing Figures

PIPE CLEANER

SUMMARY AND BACKGROUND OF THE INVENTION

The invention is a device for cleaning tobacco residues from pipes, said device comprising a hairpin-shaped wire having one leg coiled to clean the pipe bowl and the other leg kinked to clean the pipe stem.

Most pipe cleaners currently marketed are disposable devices made of felt, which when used push the tobacco residues onto the edges of the bowl of the pipe, but do not remove the residues entirely.

An object of the present invention is to provide a device which will remove the tobacco residues from the pipe, thus cleaning the pipe more thoroughly and thereby providing better tobacco flavor the next time the pipe is smoked.

Another object of the invention is to provide a pipe-cleaning device which is reusable. The present invention can be cleaned by wiping it with a tissue, and it can be stored and re-used indefinitely.

DESCRIPTION OF THE PREFERRED EMBODIMENT OF THE INVENTION

The invention is a device for cleaning tobacco residue from pipes. The device is a piece of wire formed into a hairpin shape, forming a loop 10 at one end, and two legs, 11 and 12, of approximately equal length. Leg 11 is coiled and leg 12 is kinked, respectively, for approximately three-fifths of their lengths, at the ends distal to loop 10. The coils and kinks of legs 11 and 12, respectively, are generally uniformly spaced.

Figure 1:
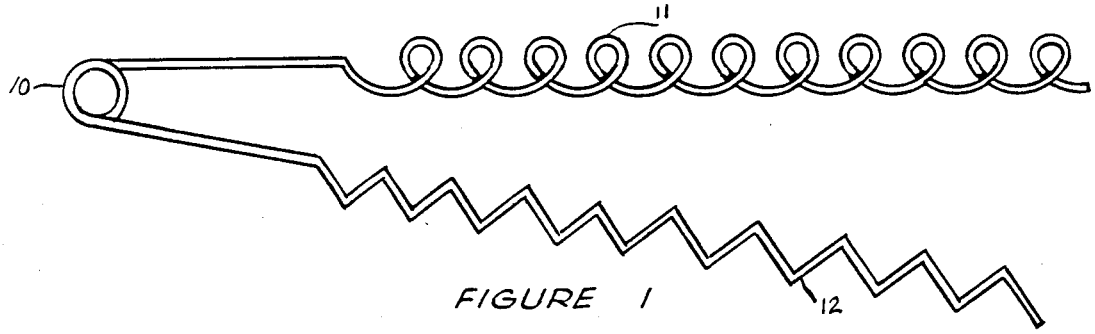
FIG. 1 is a top view of the invention.
Figure 2:
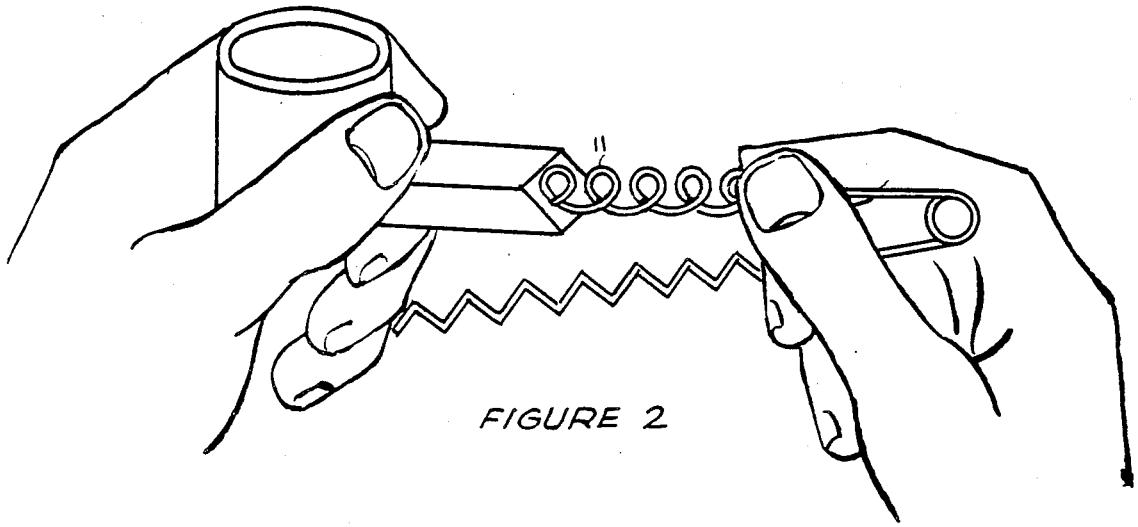
FIG. 2 shows the use of the coiled leg to clean the bowl of a pipe.
Figure 3:
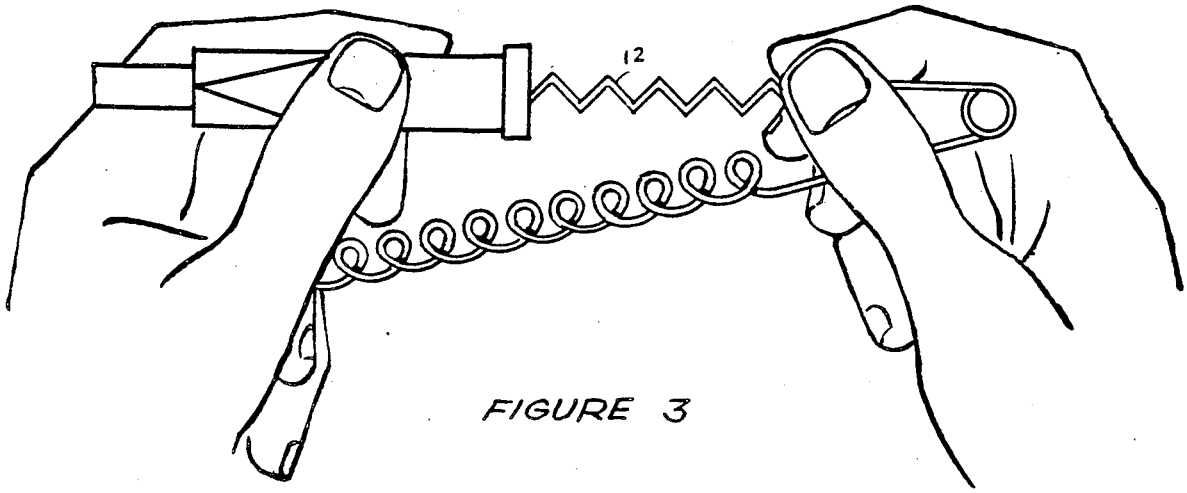
FIG. 3 shows the use of the kinked leg to clean the stem of the pipe.

The coiled leg 11 is used to clean the bowl and base of the bowl of the pipe. The coiled leg 11 is twisted and rotated in the base of the bowl to ream out the residue, as shown in FIG. 2. The kinked leg 12 is used to clean the stem of the pipe, by using a plunging motion, as shown in FIG. 3. The legs 11 and 12 can be pushed together to enable the device to be stored in a holder such as a plastic straw when not in use. The device can be wiped with a tissue after use, and is reusable indefinitely.

I claim:

1. A device for cleaning tobacco residues from pipes, said device comprising:

a generally hairpin-shaped wire formed into a loop at one end and having two legs, one of which is coiled for the majority of its length and is capable of being used to clean tobacco residues from the bowl of a pipe by using a twisting and rotating motion, and the other of which is kinked for the majority of its length and is capable of being used to clean tobacco residues from the stem of a pipe by using a plunging motion, said legs being capable of being spread apart or pushed together.

* * * * *